United States Patent [19]

Manning

[11] Patent Number: 4,529,109

[45] Date of Patent: Jul. 16, 1985

[54] COLLAR STRETCHING APPARATUS

[76] Inventor: Weldon Manning, 9 Daleswood Dr., Rochester, N.Y. 14625

[21] Appl. No.: 564,169

[22] Filed: Dec. 22, 1983

[51] Int. Cl.[3] ..... D06C 3/00

[52] U.S. Cl. ..... 223/52.1; 223/61; 223/69; 223/89

[58] Field of Search ..... 223/52.1, 52, 61, 63, 223/65, 66, 69, 74, 85, 89, 2

[56] References Cited

U.S. PATENT DOCUMENTS 2,513,980 7/1950 Widmann ..... 223/89

2,817,470 12/1957 Simon ..... 223/89

2,958,447 11/1960 Rouseau ..... 223/69

4,364,495 12/1982 Walker ..... 223/61

*Primary Examiner*—Werner H. Schroeder

*Assistant Examiner*—Judith L. Kravitz

*Attorney, Agent, or Firm*—Cumpston & Shaw

[57] ABSTRACT

Apparatus for stretching the neck of a garment includes a base shaped to fit within the yoke of a shirt or the like and a pair of upstanding members pivotally attached to the base. A turnbuckle is disposed between the upstanding members for adjusting the spacing between them.

3 Claims, 2 Drawing Figures

COLLAR STRETCHING APPARATUS

This invention relates in general to apparatus for restoring clothing that has been shrunk by repeated laundering to its original size, and more particularly, to a device for stretching the collars of shirts and turtleneck sweaters.

The increasing popularity of natural fibers, such as cotton, wool and the like, has exacerbated the shrinkage problem created by the laundering of clothing and especially shirts. Frequently, after one or more washings, the collars of shirts made of these natural fibers have shrunk to an extent that they no longer fit properly thereby creating an unwearable garment or one which is exceedingly uncomfortable. Often times, when such garments are worn, increased strain placed on the collar buttons because of shrinkage results in the loosening and sometimes the detachment of the buttons, thereby creating great embarrassment and inconvenience for the wearer.

While devices are known for reversing the shrinkage of shoes and hats and the body portions of turtleneck sweaters and the like, heretofore, no device particularly designed to restore the collars of shirts and the like to their original size have been available.

Accordingly, it is an object of this invention to provide apparatus for stretching the collar of a shirt or turtleneck sweater or the like to enlarge the size thereof.

It is another object of this invention to provide such apparatus that is easy to manufacture at a relatively low cost.

It is a further object of this invention to provide such apparatus that is adjustable over a wide range while retaining the capability for fine adjustment necessary to provide appropriate tension on the collar on which the device is used.

Briefly stated, and in accordance with a presently preferred embodiment of this invention, collar stretching apparatus is provided having a body portion contoured to fit within the yoke of a shirt or blouse and having a pair of upstanding spreader members pivotally attached thereto. Each of the upwardly extending spreader bars is provided at one end thereof with a projection adapted to be received within a plurality of positioning slots spaced apart a predetermined distance to provide coarse adjustment of the distance between the bars. At the opposite end of each of said bars, continuously adjustable spreader means are provided for fine adjustment of the spacing between such bars and for applying pressure therebetween for accomplishing the desired spreading action.

Intermediate the two ends of the bars, means are provided for maintaining the orientation of said bars and preventing the same from twisting when pressure is applied therebetween.

In accordance with a presently preferred embodiment of this invention, the base portion of the spreader and the upstanding arms are formed from a sheet of metal by stamping or the like, while the continuously variable upper spreader means are connected together by a turnbuckle.

The novel aspects of the invention are set forth with particularity in the appended claims. The invention itself, along with further objects and advantages thereof, may be more readily understood by reference to the following detailed description thereof taken in connection with the accompanying drawing in which:

Figure 1:
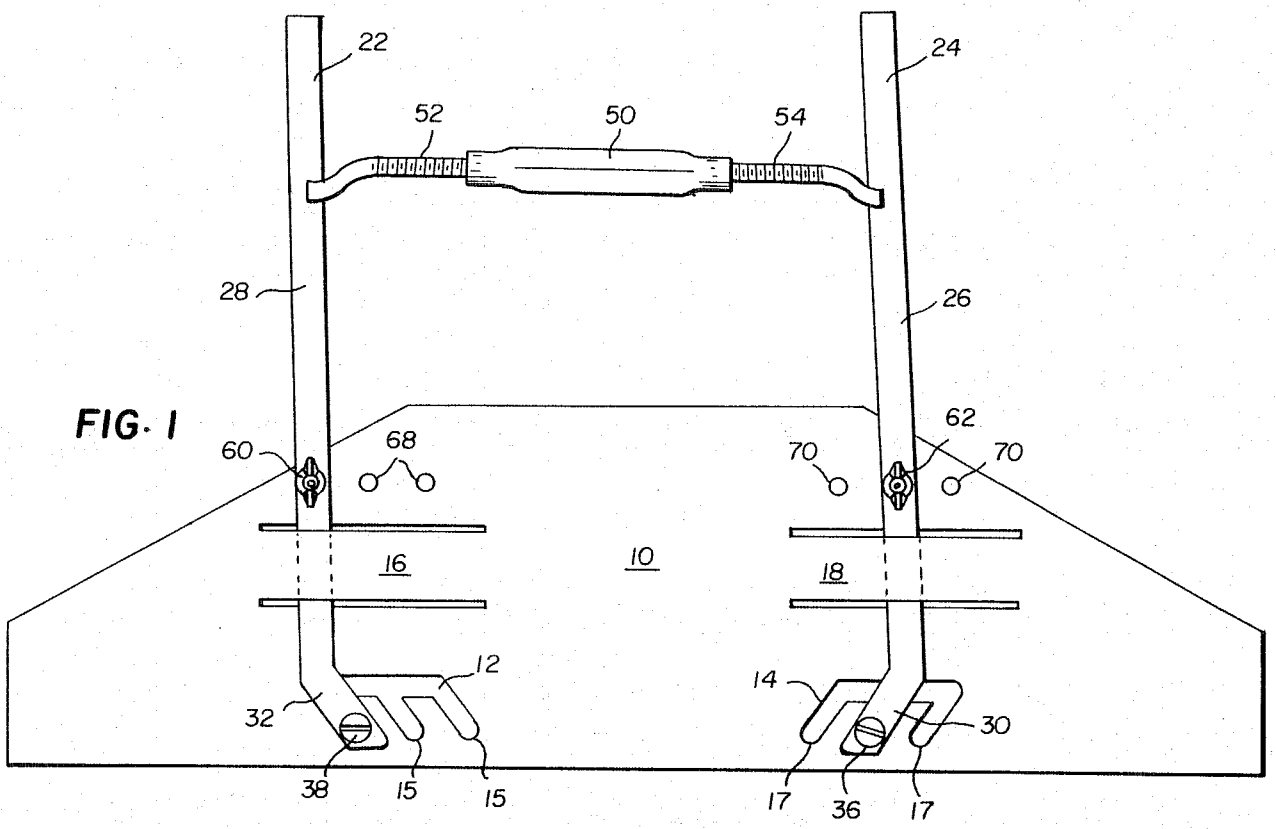
FIG. 1 is a front elevational view of collar stretching apparatus in accordance with a presently preferred embodiment of this invention.
Figure 2:
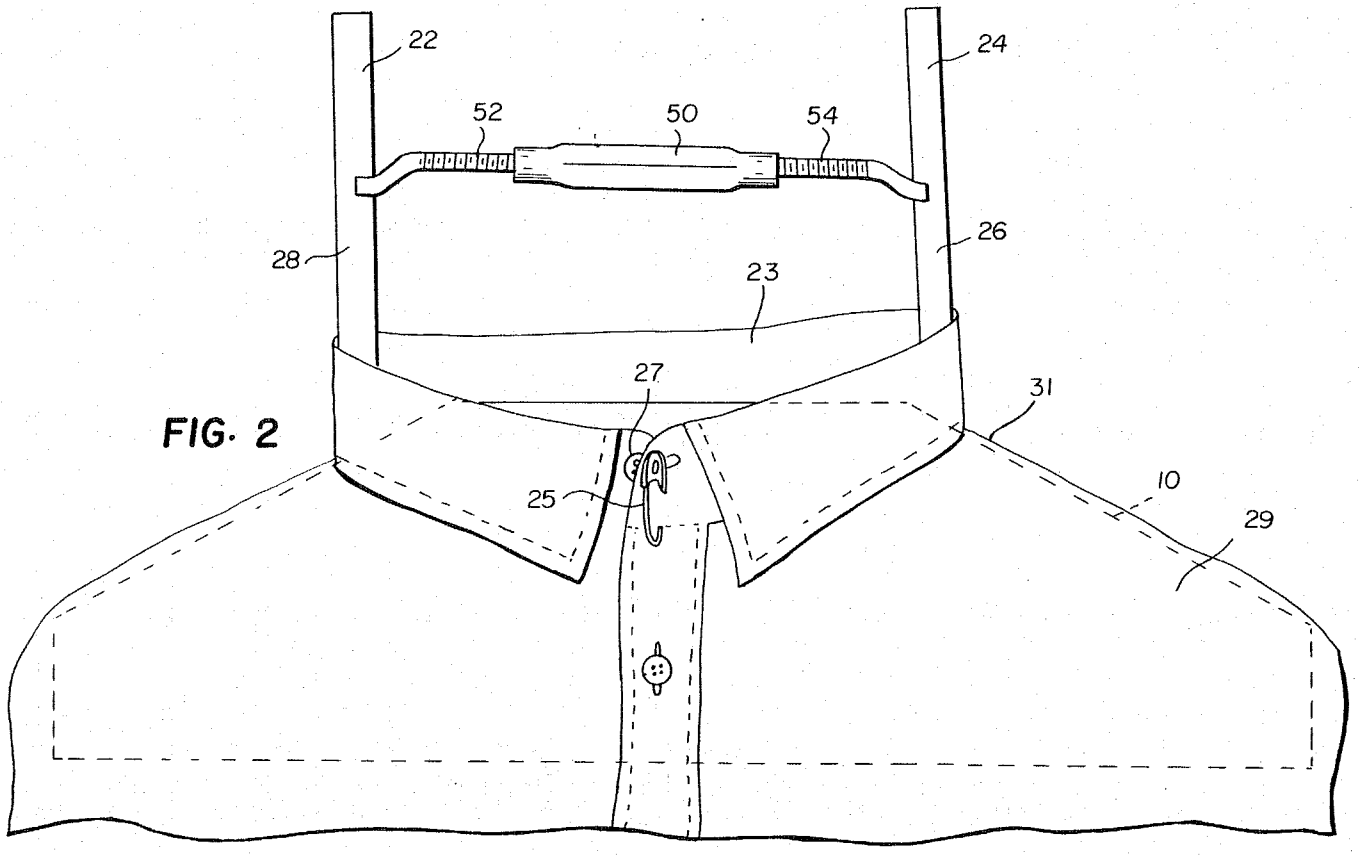
FIG. 2 is a front elevational view of the collar stretching apparatus of FIG. 1 having a shirt mounted thereon for stretching.

Referring now to FIG. 1, a collar stretcher in accordance with a presently preferred embodiment of this invention includes a body 10 having a generally rectangular shape with cut-off upper corner portions adapted to fit with the yoke of a shirt of blouse as may be readily appreciated with reference to FIG. 2. Body 10 includes first and second spaced apart slots 12 and 14 therethrough each characterized by a horizontal portion and first and second pluralities of inclined downwardly extending fingers 15 and 17 respectively depending therefrom. Spaced generally above slots 12 and 14 and generally in alignment therewith, are first and second swaged guide slots 16 and 18 preferably formed by making incisions defining the edges thereof in base 10 and displacing the web of material thus formed, from the plane of base 10 whereby spreader members 22 and 24 pass through the lower incision, beneath the web of material and through the upper incision.

First and second upstanding spreader members 22 and 24 each include a major elongate portion 26 and 28, respectively and minor portions 30 and 32, respectively, forming an angle with major portions 26 and 28 somewhat in the manner of a dog leg. Minor portions 30 and 32 are provided with guide means such as posts 36 and 38 extending perpendicularly therefrom and adapted to be received within and guided by the fingers of slots 12 and 14.

Continuously adjustable spreader means are coupled between the ends of major portions 26 and 28 and include first and second threaded members 52 and 54 and a internally threaded link 50 adapted to receive rods 52 and 54 in the manner of a turnbuckle. Threaded members 52 and 54 are fixedly attached to spreader members 22 and 24. As link 50 is rotated, force is exerted on spreader members 22 and 24 forcing them outward.

In operation, depending upon the size of the collar to be stretched, posts 36 and 38 are positioned in the appropriate ones of fingers 15 and 17 to position spreader members 22 and 24 in the collar of the garment to be stretched with a slight amount of tension. Thereupon, link 50 may be adjusted to increase the spacing between spreaders 22 and 24 to exert any desired amount of pressure on the collar. It is a particular advantage of this invention that a wide range of collar sizes may be accommodated while maintaining the spreaders in close to parallel relationship. In this way, the collars are stretched evenly and consistant results are obtained.

In accordance with an alternative embodiment of this invention, one of spreaders 22 and 24 may be provided with an opening 60 or 62 aligned with one of corresponding openings 68 and 70 in base 10. Each of openings 68 and 70 is aligned generally above one of fingers 15 and 17, respectively, and is adapted to receive a temporary fastener such as a wing nut and bolt therethrough to secure a major portion 26 or 28 of one of spreaders 22 and 24 to base 10. Such fastners greatly increase the rigidity of spreaders 22 and 24 with respect to base 10 and are preferably employed when heavy fabrics such as flannel are stretched. It will be understood that while fasteners are illustrated in both openings 68 and 70, only one would be used at any one time.

The operation of spreader 10 may be more fully appreciated by referring now to FIG. 2 wherein spreader 10 is illustrated having a shirt 29 mounted thereon. Preferably, shirt 29 is fastened at the collar opening thereof with a pin 25 or other temporary fastening device to prevent undue strain on collar button 27. As heretofore described, spreaders 22 and 24 are positioned in the appropriate ones of fingers 15 and 17 to provide a snug but not tight fit within the collar. Thereafter, link 50 is tightened to exert an increasing amount of force on spreaders 22 and 24 until the collar is tight.

As is well known, it is preferred to dampen fabrics prior to stretching, and accordingly, spreader 10 is generally employed immediately after washing the garment but before drying of the same or alternatively, when the garment is dry, by premoistening at least the collar thereof prior to mounting of the same on spreader 10.

While this invention has been described in connection with a presently preferred embodiment thereof, many modifications and changes will occur to those skilled in the art without departing from the true spirit and scope of the invention, which accordingly, is intended to be limited solely by the appended claims.

I claim:

1. Apparatus for stretching the collar of a garment comprising:

a base having a peripheral shape adapted to fit within the yoke of said garment;

at least a first plurality of substantially parallel slots in said base, said slots jointed at one end thereof by an elongated connecting slot to form a generally comb-shaped slot;

first and second spaced apart elongated upstanding spreaders attached to said base at a point between the ends of said spreaders;

means on one end of at least one of said spreaders engaging said comb-shaped slot and movable among said substantially parallel slots for adjusting the spacing between said spreaders while maintaining said spreaders substantially parallel to each other; and means coupled between said spreaders for continuously adjusting the spacing therebetween for exerting a stretching force on the neck of the garment.

2. The apparatus of claim 1 wherein said base comprises a substantially rigid plate having a rectangular lower portion and a trapizoidal upper portion.

3. The apparatus of claim 1 further comprising a turnbuckle disposed between said spreaders.

* * * * *